United States Patent [19]

Bezhanov et al.

[11] 4,247,269

[45] Jan. 27, 1981

[54] CONCRETE PLACING APPARATUS

[76] Inventors: Tigran V. Bezhanov, ulitsa Galaktiona Tabidze, 3/5, kv. 4; Edisher G. Rcheulishvili, ulitsa Tabidze, 39; David G. Gordeziani, ulitsa Galaktiona Tabidze, 3/5, all of Tbilisi; Vladimir A. Bezhanov, ulitsa Papanina, 56, kv. 37, Baku, all of U.S.S.R.

[21] Appl. No.: 113,473

[22] Filed: Jan. 21, 1980

[51] Int. Cl.[3] ..... B28B 13/00; B28B 19/00

[52] U.S. Cl. ..... 425/63; 425/224; 425/329; 425/371; 425/456; 425/471

[58] Field of Search ..... 425/62-64, 425/224, 329, 447, 456, 471, 371; 264/333, 33, 34, 70

[56] References Cited

U.S. PATENT DOCUMENTS

| | | | |
|---|---|---|---|
| 3,200,177 | 8/1965 | Dodd | 264/70 |
| 3,799,714 | 3/1974 | Vetovitz | 425/63 |

FOREIGN PATENT DOCUMENTS

| | | | |
|---|---|---|---|
| 637260 | 12/1978 | U.S.S.R. | 264/70 |

*Primary Examiner*—W. E. Hoag
*Attorney, Agent, or Firm*—J. Harold Nissen

[57] ABSTRACT

A concrete placing apparatus comprises a power-operated carriage and mounted thereon a feed hopper, a first and a second endless belts adapted for moulding lateral sides of a concrete layer being formed, and mounted parallel to one another on rolls having a vertical axis of rotation, and a concrete compacting mechanism. The latter is constructed in the form of a third and a second endless belts disposed in one horizontal plane above the first and second endless belts. The third endless belt is intended for exertion vibration action upon the concrete mix being placed, and is mounted on two rolls having a horizontal axis of rotation, at least one of said rolls being provided with unbalances mounted therein on its driving shaft coaxial therewith. The fourth belt is intended for damping vibration of a freshly placed concrete and mounted on rolls having a horizontal axis of rotation behind the third endless belt.

4 Claims, 9 Drawing Figures

CONCRETE PLACING APPARATUS

FIELD OF THE INVENTION

The present invention relates to construction machinery and more particularly to a concrete placing apparatus.

The invention can be used for casting solid concrete and reinforced concrete walls. The invention is also applicable for producing prefabricated articles from the materials mentioned.

DESCRIPTION OF THE PRIOR ART

Most of concrete placing apparatus now in use have a common disadvantage which lies in that moulding lateral sides of a wall being cast is carried out by means of moulding elements sliding along the concrete wall being erected (cf. the USSR Author's Certificate No. 246,020).

In the above concrete placing apparatus with the sliding moulding elements the coefficient of friction between these elements and concrete mix surface is very high, which necessitates a more powerful drive, and hence, a higher energy consumption. Therefore, to ensure a required finish quality it is necessary to limit the speed of movement of the concrete placing apparatus, which reduces the efficiency of the concrete placing operation. In addition, since the concrete mix represents an abrasive material the rate of wear of the moulding elements is relatively high.

Furthermore, the concrete placing apparatus with the moulding elements of a sliding type can produce only a simple finishing pattern, namely in the form of horizontal lines. Therefore more complex pattern is produced by hand after the wall has been errected.

There is also known a concrete placing apparatus wherein moulding lateral sides of the concrete layer is effected by rolling moulding elements on the concrete mix (cf. the USSR Pat. No. 438,162). The concrete placing apparatus of this type comprises a power-operated carriage carrying a feed hopper, a first and a second endless belts, for moulding lateral sides of a concrete layer being formed, mounted parallel to each other on rolls with a vertical rotating axis, and a compacting mechanism.

In the above concrete placing apparatus the concrete compacting mechanism is made in the form of a surface vibrator exerting a percussion action on the concrete layer being formed.

In addition, due to the fact that in this concrete placing apparatus the moulding elements are made in the form of endless belts the friction coefficient between these elements and the concrete surface is reduced.

However, this concrete placing apparatus has some disadvantages one of which lies in that it doesn't provide for uniform compaction of concrete, which necessitates a special beam for leveling the compacted concrete. This complicates the concrete placing apparatus construction.

Furthermore, residual vibration in the moulded concrete occurring after compaction causes loosening of the freshly placed concrete and, hence, distortion of the specified dimensions of the wall being cast.

It should be noted that the above concrete placing apparatus is applicable only for producing prefabricated reinforced concrete articles, and in particular long U-shaped articles of one size and is not capable of casting solid concrete walls on the construction site.

SUMMARY OF THE INVENTION

The main object of this invention is to provide a concrete placing apparatus providing more uniform compaction of the freshly placed concrete and damping of risidual vibration therein.

It is a further object of the invention to provide a concrete placing apparatus capable both of manufacturing prefabricated reinforced concrete articles and solid concrete walls on the construction site.

An additional object of the invention is to provide a concrete placing apparatus capable of casting solid walls having inclined front of back sides.

Among the other objects of this invention is the provision of a concrete placing apparatus simple in construction and convenient in operation.

These and other objects of the invention are attained in that in a concrete placing apparatus comprising a power-operated carriage carrying a feed hopper, a first and a second endless belts for moulding lateral sides of a layer being formed, installed parallel to each other on rolls having a vertical axis of rotation, and a concrete compacting means, according to the invention the concrete compacting means includes a third endless belt for vibrating concrete, positioned above the first and the second endless belts and mounted on rolls having a horizontal axis of rotation, at least one of which rolls is provided with an unbalance installed therein on a driving shaft coaxial with this roll and a fourth endless belt for damping vibration of the freshly compacted concrete, mounted on rolls with a horizontal axis of rotation and positioned behind and in the same plane with the third endless belt.

Such construction of the concrete placing apparatus provides for simultaneously moulding, uniform compacting and levelling freshly placed concrete as well as damping vibration of the compacted concrete. Due to this construction the spontaneous loosening of the freshly placed concrete is ruled out, thereby preserving the specified dimensions of the concrete layer being formed.

It is advisable to provide one of said third and fourth endless belts with a projection for producing a groove on the freshly placed concrete to provide a tie between adjacent concrete layers and to thereby increase a durability of the wall being errected.

It is desirable that at least one of the above first and second endless belts have a mechanism for angular positioning this belt relative to the plane in which the third and fourth endless belts are disposed, which mechanism being made in the form of a power cylinder arranged on the above mentioned carriage and having a piston connected to the corresponding endless belt by means of a rod.

The above concrete placing apparatus provides casting walls with inclined front or back sides and walls with a variable thickness. It also enables construction of inclined retaining walls for strengthening the reservoir shores.

BRIEF DESCRIPTION OF THE DRAWINGS

The invention will now be explained in greater detail with reference to embodiments thereof taken in conjunction with the accompanying drawings, wherein.

DETAILED DESCRIPTION OF THE INVENTION

Figure 1:
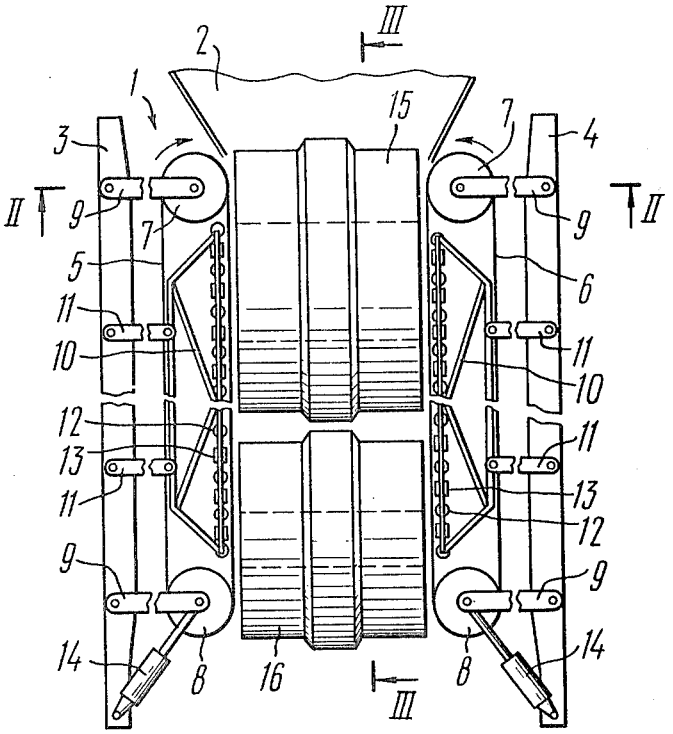
FIG. 1 schematically represents a top view of the concrete placing apparatus according to the invention (hereinafter the direction of movement of the concrete placing apparatus and of the endles belts are shown by arrows)

The concrete placing apparatus comprises a power-operated carriage I (FIG. 1) and a feed hopper 2 mounted thereon.

The power-operated carriage I includes an undercarriage and a frame on the longitudinal beams 3 and 4 of which are mounted endless belts 5 and 6 respectively, which belts are adapted for moulding lateral sides of a concrete layer being formed. The endless belts 5 and 6 are mounted parallel to one another and on driving rolls 7 and tension rolls 8 having a vertical rotation axis and being pivotally secured on the beams 3 and 4 by means of levers 9.

Figure 2:
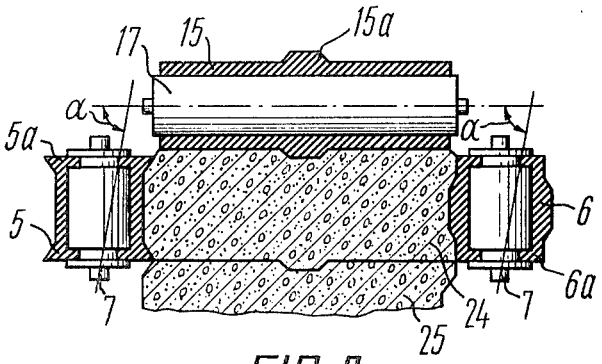
FIG. 2 is a cross section of the concrete placing apparatus, taken along line II—II of FIG. 1 (the power-operated carriage is not shown)

To securely keep the endless belts 5 and 6 on the rolls 7 and 8 these belts have lateral projections 5*a* and 6*a* engaged in grooves provided on the said rolls as shown in FIG. 2.

Each endless belt 5 and 6 may be made either from one piece of flexible belt or from individual plates pivotally connected with each other to form endles belt, in which case the belt is recommended to be driven by a drive comprising a chain and star wheels.

Between moulding and return belts of each endless belt 5 and 6 is located a girder 10 pivotally connected by means of levers II on the respective beam 3 or 4 and having supporting rollers 12 and slides 13 upon which the moulding belts of the endless belts rest, thereby limitting the amount of deflection of the said belts of the endless belts 5 and 6 in the direction of the beams 3 and 4, and maintaining a predetermined distance between said belts and, hence, casting a wall with specified allowances.

The endless belts 5, 6 together with rolls 7, 8, beams 3, 4 and levers 9 form two link parallelograms permitting the distance between the said belts to be varied, thus changing the thickness of the article being produced.

Varying the configuration of the above parallelograms can be effected by any conventional method, for example, by using for each of the endless belts 5 and 6 a screw pair 14 (FIG. 1) the nut of which is secured on the beam 3 (or 4), and the male screw is coupled with the tension shaft 8.

The screw pair 14 permits through the shaft 8 connected with the lever 9 varying the angular position of the latter relative to the beam 3 (or 4), and, hence, the distance between this beam and the respective endless belt 5 or 6. It is apparent that this drive may be otherwise constructed, for example, in the form of a hydraulic cylinder.

Figure 3:
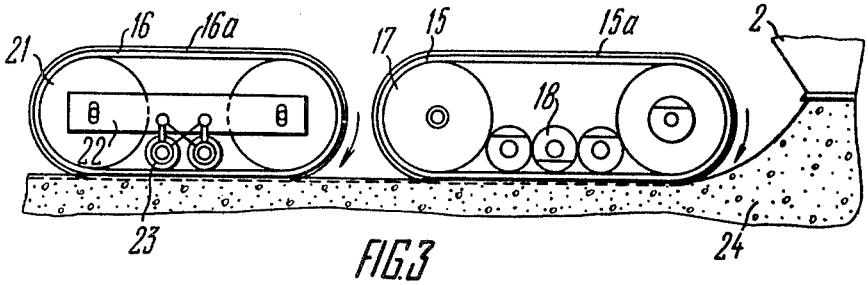
FIG. 3 is a cross section of the concrete placing apparatus, taken along line III—III in FIG. 1.

The concrete placing apparatus also have a concrete compacting means which is constructed, according to the invention, in the form of two endless belts 15 and 16 disposed in a common horizontal plane above the endless moulding belts 5 and 6 as shown in FIGS. 2 and 3.

The belt 15 is adapted for compacting by vibration the concrete being placed and is mounted on two rolls 17 having horizontal axis of rotation. At least one of the rolls 17 (FIGS. 3 and 4) is provided with unbalances 18 mounted therein on the shaft 19 coaxial with this roll and connected with a drive 20.

Figure 4:
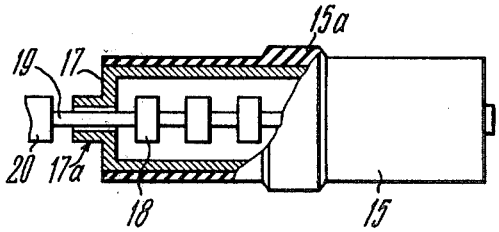
FIG. 4 is an endless belt for compacting concrete by vibration, and a partial section of one of its rolls, showing unbalances mounted inside this roll.
Figure 8:
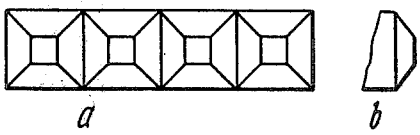
FIGS. 8 and 9 are the finishing patterns which can be produced by the proposed apparatus on the wall in the course of its being formed (a—front view, b—left side view).
Figure 9:
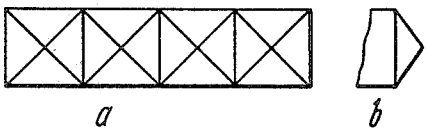

The roll 17 is connected for rotation to any conventional drive (not shown). The connection with the drive may be effected, for instance at the roll portion 17*a* (FIG. 4). Such connection may be otherwise variously effected. In case when a slight vibration is sufficient to compact the concrete being placed the roll 17 is rigidly set on the shaft 19. Preferably, the roll 17 and the shaft 19 are rotating with different speeds, the rotation speed of the shaft 19 exceeding the rotation speed of the roll 19, which considerably improves vibration efficiency and which is very important in compacting heavy and high-grade concretes.

The vibration efficiency can be improved by mounting unbalances 18 not inside the rolls 17 but therebetween above the moulding belt of the endless belt 15 as shown in FIG. 3.

The endless belt 16 is intended for damping residual vibration of the freshly placed concrete after the latter being vibrated by the compacting endless belt 15. The endless belt 16 is passed over the driving rolls 21 with a horizontal axis of rotation and positioned behind the endless belt 15, if viewed in the direction of movement of the apparatus.

The efficiency of damping vibration is raised by that the endless belt 16 is loaded in any conventional manner. According to what is disclosed herein the rolls 21 are loaded with a beam 22 exerting through rolls 21 pressure from inside upon the belt. It is also possible to increase the weight of the belt 16 relative to the belt 16 by that the belt 15 is made from a material having higher density or greater thickness.

It is expedient to provide one or both endless belts 15 and 16 of the concrete compacting means with a projection 15*a* and 16*a* respectively, intended to produce in the concrete layer 24 grooves as shown in FIGS. 2, 3 and 4.

The grooves thus formed are intended to provide a tie between adjoining concrete layers, which is attained by that these grooves are filled with concrete during forming a next layer over the previously formed one. FIG. 2 shows such tie between two layers 24 and 25. These ties prevent water from penetration therethrough, thereby raising the strength and durability of a concrete solid wall.

This permits the apparatus of the above modification to be used for casting in layers solid concrete walls directly on the construction site. For vertically moving the carriage with the endless belts 5, 6, 15 and 16 can be used any known in the art suitable lifting device.

It is advisable to provide at least one of the endless belts 5 (FIG. 2) and 6 with a mechanism for varying an angle $\alpha$ at which this belt is installed relative to the plane in which the belts 15 and 16 are positioned.

Figure 5:
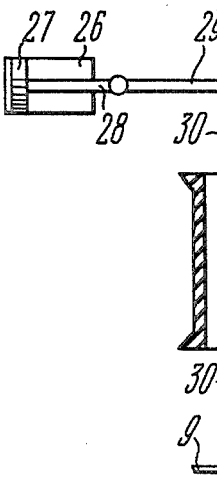
FIG. 5 shows a mechanism for varying the angular position of the endless belt intended for moulding one of the lateral sides of the concrete layer being formed, relative to the plane in which are disposed endless belts of the compacting means.

The above mechanism (FIG. 5) is made in the form of a hydraulic cylinder 26. The piston 27 rod 28 of this cylinder is connected with the shaft 7 or 8 of the respective belt by means of a pull rod 29 pivotally connected at one its end with the piston rod and at its other end with one of the upper bearings 30 wherein the shaft is installed. The lower bearing 30 is set on a horizontal axle 31 for rotation thereabout.

Figure 6:
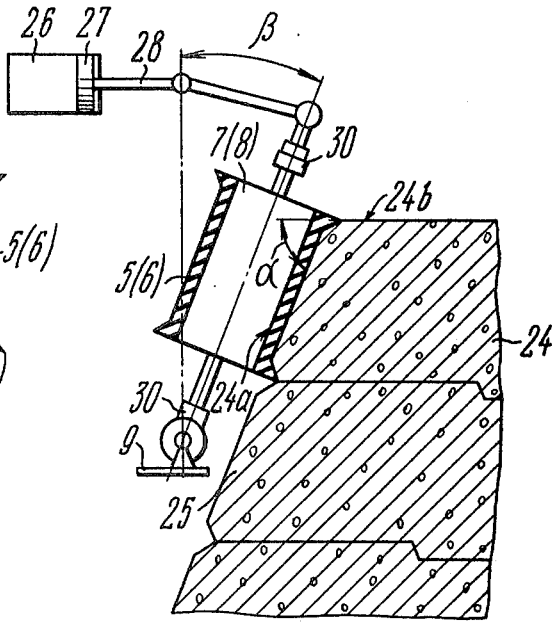
FIG. 6 schematically represents casting in-layers a solid concrete wall with an inclined front side by means of the mechanism in FIG. 5, front view.
Figure 7:
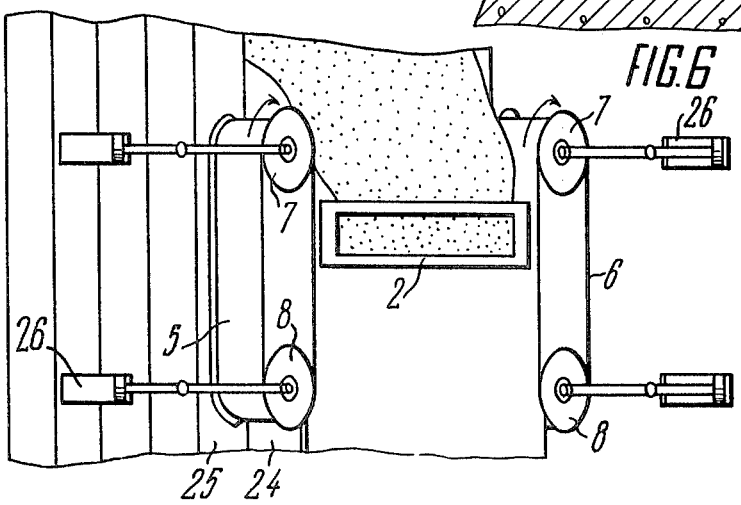
FIG. 7 is the same as in FIG. 6, top view.

Such construction provides for varying an angle $\beta$ of the shaft 7 (8) axis relative to a vertical line, thereby permitting the formation of the concrete layer 24 having its lateral sides 24*a* inclined relative its upper plane 24*b* to 90°-$\beta$ (FIG. 6). This permits manufacturing such concrete articles in factories or erecting in-layers solid concrete walls directly on the construction site as shown in FIGS. 6 and 7, with inclined front and or back lateral sides. The proposed concrete placing apparatus embodied as disclosed above is convenient, in particular for erecting inclined retaining walls for strengthening reservoir shores.

The proposed concrete placing apparatus operates as follows. By rotating the screw pairs 14 (FIG. 1) the endless belts 5 and 6 are positioned at a desired distance from one another. In the case of casting concrete solid walls with inclined front and/or back lateral sides the endless belts 5 and 6 are positioned by means of hydraulic cylinders 26 (FIG. 5) at an angle.

After the feed hopper is filled with the concrete mix the concrete placing apparatus is started and begins to move along the center line of the wall being errected, on the ground or on the previously formed concrete layer 25. Simultaneously, the rolls 7, 8, 21 and 17 are driven to move the belts 5, 6, 15 and 16 which are moving in the directions shown in the drawings by arrows, with the moulding portions of these belts moving in the direction opposite to the movement of the apparatus and the linear speed of the belts being equal to the speed of movement thereof.

The gate of the feed hopper 2 opened, the concrete mix continuously pours out to continuously form before the moving belts 5, 6, 15 and 16 a heap of concrete mix which is drawn by the belts into the space defined thereby to form the concrete layer 24 (FIG. 3).

In the course of forming the concrete layer 24 the unbalances 18 (FIG. 4) disposed inside the rolls 17 of the endless belt 15 rotate with a speed exceeding the rotation speed of these rolls, thereby causing vibration of the belt 15 and, hence, vibration and compaction of the freshly placed concrete.

The endless belt 16 (FIG. 3) moving immediately behind the belt 15 prevents spread of residual vibration in the concrete mix, thus damping them, which enables the specified dimensions of the concrete layers being formed to be maintained.

The projections 15*a* and 16*a* formed on the moulding endless belts 15 and 16 produce in the concrete layer a groove intended to provide a tie between adjoining concrete layers as disclosed above.

After the formation of one layer is finished the carriage I is lifted to a height of the next layer to be formed and the whole operation cycle repeats. In manufacturing prefabricated concrete articles the carriage I is not needed to be moved upwards.

The proposed concrete placing apparatus is also capable of producing a desired finishing pattern on the wall being errected. In this case such patterns may be formed directly on the moulding belts 5 and 6 as a one-piece-construction as shown in FIG. 2, or made in the form of a detachable pattern sweep made from a metal or synthetic material and attached to the said belts in the case of need.

In the case of detachable sweeps the latter may have either complete pattern or only a portion thereof in which case in order to produce a complete pattern on the wall being errected it is necessary that each time, when a next layer is started, a corresponding portion of the sweep be attached to the moulding belt 5 or 6. Shown in FIGS. 6 and 7 are two possible finishing patterns which can be produced by the proposed concrete placing apparatus. The pattern may be more complex one, and owing to the fact that the moulding endless belts roll over the surface of the concrete layer being formed they leave thereon a distinct imprint of their pattern.

The proposed concrete placing apparatus ensures uniform compaction of the concrete mix being placed in layers and rules out its spontaneous loosening by the residual vibration. In the case of the concrete mix having a water:cement ratio of from 0.3 to 0.4 the residual vibration damp within from 1.5 to 2 min.

While the invention has been described herein in terms of the preferred embodiments, numerous variations may be made in the apparatus illustrated in the drawings and herein described without departing from the invention as set forth in the appended claims.

What we claimed is:

1. A concrete placing apparatus comprising:

a power-operated carriage;

a feed hopper mounted on said power-operated carriage;

a first and a second endless belts for moulding lateral sides of a concrete layer being formed, and mounted parallel to one another on said power-operated carriage on rolls with a vertical axis of rotation; a concrete compacting mechanism mounted on said power-operated carriage and including:

a third endless belt adapted for vibrating concrete;

rolls having horizontal axis of rotation and carrying said third endless belt.

unbalances mounted inside at least one of said rolls on a driving shaft coaxial with this roll;

a fourth endless belt for damping vibration of a freshly placed concrete, mounted on rolls with a horizontal axis of rotation and disposed behind and in the same plane with said third endless belt.

2. A concrete placing apparatus as claimed in claim 1, wherein at least one of said third and fourth endless belts has a projection to produce a groove in the concrete layer being formed for providing a tie between this layer and the next one.

3. A concrete placing apparatus as claimed in claim 1, wherein at least one of said first and second endless belts has a mechanism for varying an angular position thereof relative to the plane in which said third and fourth endless belts, are disposed said mechanism being constructed in the form of a power cylinder mounted on said power-operated carriage, and a pull rod connecting a piston of said cylinder with the rolls of the respective endless belt.

4. A concrete placing apparatus as claimed in claim 2, wherein at least one of said first and second endless belts has a mechanism for varying an angular position thereof relative to the plane in which said third and fourth endless belts are disposed, said mechanism being constructed in the form of a power cylinder mounted on said power-operated carriage, and a pull rod connecting a piston of said cylinder with the rolls of the respective endless belts.

* * * * *